US005609141A

United States Patent [19]

Matsuoka et al.

[11] Patent Number: 5,609,141

[45] Date of Patent: Mar. 11, 1997

[54] EVAPORATIVE FUEL CONTROL DEVICE

[75] Inventors: Hiroki Matsuoka, Susono; Norihisa Nakagawa, Numazu, both of Japan

[73] Assignee: Toyota Jidosha Kabushiki Kaisha, Aichi, Japan

[21] Appl. No.: 492,262

[22] Filed: Jun. 19, 1995

[30] Foreign Application Priority Data

Jun. 22, 1994 [JP] Japan ..... 6-140064

[51] Int. Cl.[6] ..... F02M 33/02; F02M 25/08

[52] U.S. Cl. ..... 123/520

[58] Field of Search ..... 123/518, 519, 123/520

[56] References Cited

U.S. PATENT DOCUMENTS

| | | | |
|---|---|---|---|
| 5,249,561 | 10/1993 | Thompson | 123/520 |
| 5,343,846 | 9/1994 | Ogawa et al. | 123/520 |
| 5,345,917 | 9/1994 | Maruyama et al. | 123/520 |
| 5,353,771 | 10/1994 | Blumenstock et al. | 123/520 |
| 5,355,863 | 10/1994 | Yamanaka et al. | 123/520 |
| 5,359,980 | 11/1994 | Tomisawa | 123/520 |
| 5,390,645 | 2/1995 | Cook et al. | 123/520 |
| 5,469,832 | 11/1995 | Nemoto | 123/520 |

FOREIGN PATENT DOCUMENTS

| | | |
|---|---|---|
| 476239A | 3/1992 | Japan . |
| 466763A | 3/1992 | Japan . |
| 526118A | 2/1993 | Japan . |
| 5231248A | 9/1993 | Japan . |

*Primary Examiner*—Thomas N. Moulis
*Attorney, Agent, or Firm*—Kenyon & Kenyon

[57] ABSTRACT

An evaporative fuel control device for an engine used in an automobile is provided. The device comprises a charcoal canister for temporary adsorbing fuel vapor produced in a fuel tank, an air introducing means for introducing air into the canister, a purge control means for controlling the amount of purge gas, purged from the canister into a intake passage of the engine and containing air and fuel vapor desorbed from the canister therein, a purge gas amount detecting means for detecting the amount of the purge gas, an air amount detecting means for detecting the amount of air introduced into the charcoal canister and a desorbed fuel amount calculating means for calculating the amount of fuel desorbed from the canister on the basis of the amount of purge gas detected by the purge gas amount detecting means and the amount of air introduced into the charcoal canister detected by the air amount detecting means.

The purge control means controls the amount of purge gas on the basis of the amount of fuel desorbed from the canister calculated by the desorbed fuel amount calculating means.

14 Claims, 9 Drawing Sheets

EVAPORATIVE FUEL CONTROL DEVICE

BACKGROUND OF THE INVENTION

1. Field of the Invention

The present invention relates to an evaporative gas control device for an automobile.

2. Description of the Related Art

An evaporative fuel control device for purging evaporative fuel, which is produced in a fuel tank and temporary adsorbed in a canister, into an intake passage of an engine is commonly known and used. A number of devices have been proposed for controlling the amount of purge gas or correcting, based thereon, the amount of fuel injected by a fuel injector (Japanese Unexamined Patent Publication No. 5-26118).

Due to recent strict emission regulations, the effect of purge gas on an exhaust emission must be tightly controlled and, accordingly, it has become important to accurately detect the amount of the fuel contained in the purge gas which is purged from the canister into the intake passage.

In the above mentioned device, the correction of the amount of fuel injected by the fuel injector, or the control of purging, is on the basis of the flow rate of a purge gas through a purge line. However, the purge gas contains air which is introduced into the canister and fuel which desorbed from the canister, therein. Therefore, the flow rate of purge gas does not accurately correspond to the amount of the fuel desorbed from the canister.

Accordingly, in the above mentioned device, an unsuitable amount of fuel can be injected from the injector, or an unsuitable control of purging can be carried out and this can cause harmful exhaust emissions.

SUMMARY OF THE INVENTION

Therefore, an object of the present invention is to provide an evaporative fuel control device which can accurately detect the amount of fuel desorbed from the canister.

According to the present invention there is provided an evaporative fuel control device for an engine used in an automobile. The device comprises, a charcoal canister for temporary adsorbing fuel vapor produced in a fuel tank, an air introducing means for introducing air into the canister, a purge control means for controlling the amount of purge gas which is purged from the canister into an intake passage of the engine and contains air and fuel vapor desorbed from the canister therein, a purge gas amount detecting means for detecting the amount of the purge gas, an air amount detecting means for detecting the amount of air introduced into the charcoal canister and a desorbed fuel amount calculating means for calculating the amount of fuel desorbed from the canister on the basis of the amount of purge gas detected by the purge gas amount detecting means and the amount of air introduced into the charcoal canister detected by the air amount detecting means.

The purge control means controls the amount of purge gas on the basis of the amount of fuel desorbed from the canister calculated by the desorbed fuel amount calculating means.

The present invention will be more fully understood from the description of preferred embodiments of the invention set forth below, together with the accompanying drawings.

DESCRIPTION OF A PREFERRED EMBODIMENT

Figure 1:
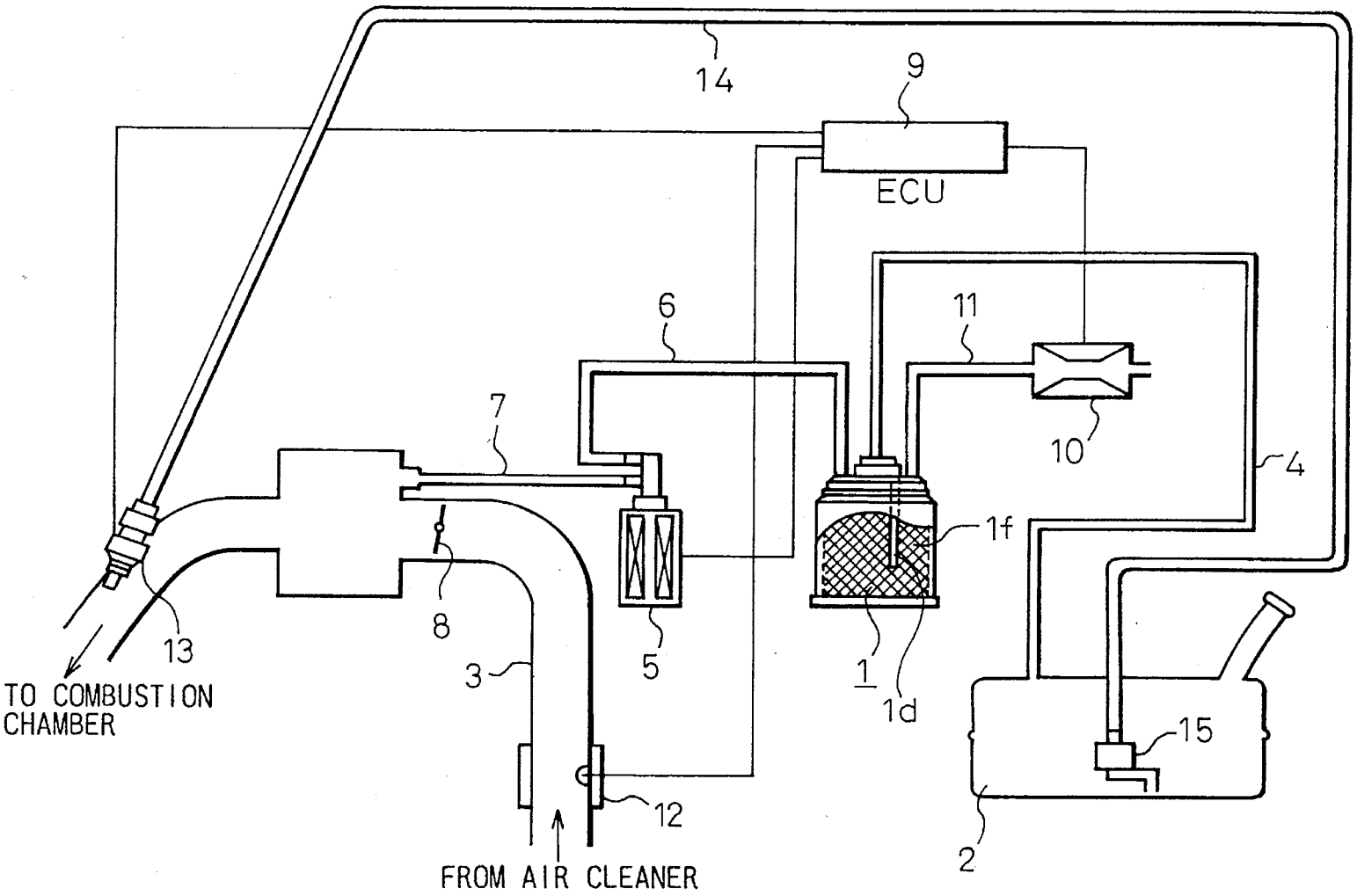
FIG. 1 is a general view of an evaporative fuel control device according to the present invention.

Referring to FIG. 1, reference numeral 1 represents a charcoal canister having an activated carbon layer if therein. The charcoal canister 1 is, on one hand, connected with a fuel tank 2 through a pipe 4, so that evaporated fuel produced in the fuel tank 2 is introduced into the charcoal canister 1 through the pipe 4 and adsorbed by the activated carbon layer 1f.

The charcoal canister 1 is, on the other hand, connected with an intake passage 3 downstream of the throttle valve 8 through a first purge line 6, second purge line 7 and a duty vacuum switching valve (hereafter called D-VSV) 5 which is interposed between these two pipes.

The D-VSV 5 is electrically connected to an engine control unit (hereafter called ECU) 9 and controls the amount of purge gas which is purged from the charcoal canister, using a duty control method, by a signal input from ECU 9.

Here, duty control is a method of control which is often used to change the rate of opening or closing of a valve, such as above described D-VSV 5. By duty control, the valve is cyclically opened and closed at a very high speed, and the ratio of the time of valve opening in one cycle, which is called duty ratio, is changed by a pulse signal from computer. For example, if one cycle of the pulse is 100 msec and the valve is opened for 50 msec, it can be said that the valve is opened with 50% duty ratio. This can give a same effect as having the valve is mechanically set at the half-opened position.

Thus the D-VSV works as the purge control means. On the other hand, the amount of purge gas from the charcoal canister 1 is detected on the basis of the above described signal from the ECU 9 to the D-VSV. Therefore, the D-VSV 5 also works as a purge gas amount detecting means, notwithstanding that the D-VSV 5 includes neither flow meter nor pressure sensor for detecting the amount of purge gas purged from the charcoal canister 1 into a intake passage of the engine. If, as an alternative, a means, such as a pressure sensor, is disposed on the purge line for detecting the amount of purge gas, the means works as a purge gas amount detecting means.

A hot wire type air flow meter 10, of which the inlet is opened to an ambient air and of which the outlet is connected to the charcoal canister 1 through a air introduction pipe 11, detects a flow rate of air introduced into the charcoal canister 1 and generates a signal. This signal is input to the ECU 9. Therefore, the air flow meter 10 works as an air amount detecting means.

An air flow meter 12 detects the amount of inlet air introduced through an air cleaner (not shown) and generates a signal. This signal is input to the ECU 9.

A fuel injector 13 which injects a fuel supplied from a fuel tank 2 through a pipe 14 is controlled by signal output from the ECU 9. The reference numeral 15 represents a fuel pump.

The ECU 9 calculates the amount of fuel desorbed from charcoal canister 1 on the basis of the purged fuel vapor and the amount of air introduced to the charcoal canister 1, therefore ECU 9 works as a desorbed fuel calculating means. Furthermore, the ECU 9 corrects the amount of fuel injected from the fuel injector 13, therefore it works as injection fuel correcting means.

Hereafter, operations of the device is described.

At first, an operation to correct the amount of fuel injected from the fuel injector, which is stated in claim 1, is described. This operation is based upon a following way of thinking.

The purge gas purged from the charcoal canister contains fuel desorbed from the activated charcoal, which is an adsorber in the charcoal canister, and air introduced into the charcoal canister through the air flow meter 10.

Therefore, when purging is carried out, the above fuel and air contained in the purge gas are added to the air introduced through the air cleaner and the fuel injected from the injector. Accordingly, the air-fuel ratio of the mixture introduced into a combustion chamber varies from the air-fuel ratio obtained when purging is not carried out. Accordingly, the amount of the fuel injected from the fuel injector is corrected to keep the air-fuel ratio the same as when purging is not carried out.

The following information is required to carry out the above described operation.

(1) The amount of air introduced through the air cleaner, hereafter abbreviated to Qa.

(2) The amount of fuel injected from the fuel injector, hereafter abbreviated to F1.

(3) The amount of air contained in a purge gas, hereafter abbreviated to PQa.

(4) The amount of fuel contained in a purge gas, hereafter abbreviated to F2.

Qa is obtained on the basis of the signal from the air flow meter 12.

F1 is obtained by dividing the value of above obtained Qa by the air-fuel ratio.

PQa is obtained on the basis of the signal from the air flow meter 10, because PQa equals to the amount of air introduced into the charcoal canister 1.

Figure 2:
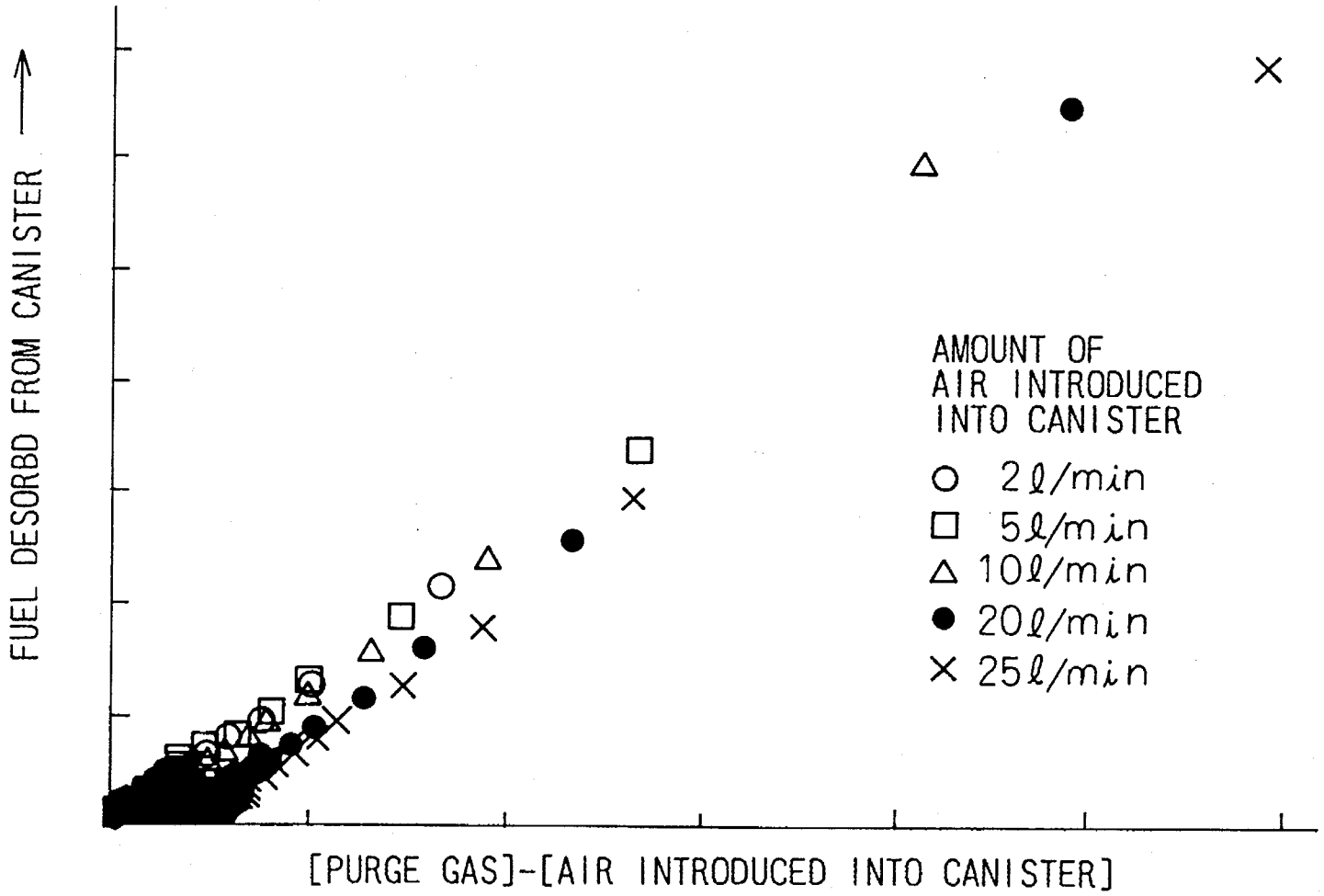
FIG. 2 is a graph showing test results of the amount of fuel desorbed from a canister corresponding to a difference between the amount of purge gas and the amount of air introduced into the canister.

F2 is obtained on the basis of the signal for duty control of the D-VSV 5 and the signal from the air flow meter 10. This is based upon knowledge gained from determining that F2 is linearly proportional to the difference between the amount of purge gas, hereafter abbreviated to PQm, and the amount of air introduced into the charcoal canister which equals to PQa. FIG. 2 shows the test results.

Figure 3:
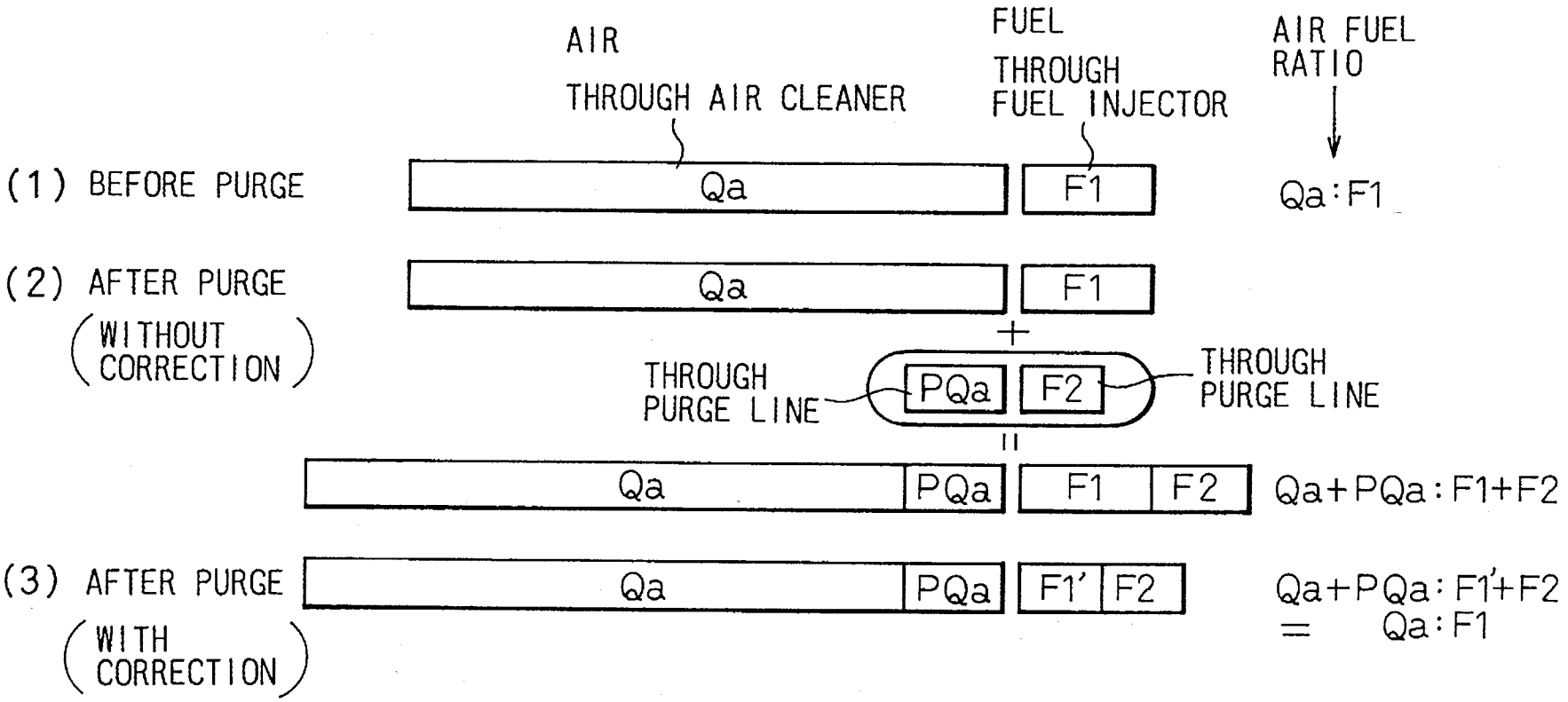
FIG. 3 is a diagram for illustrating the correction to the amount of fuel injected by the fuel injector.

FIG. 3 schematically illustrates the above described way for correcting the amount of fuel injected from the fuel injector so that the air-fuel ratio is kept the same as before the purging. In FIG. 3, F1' represents the fuel to be injected from the injector by the correction.

Figure 4:
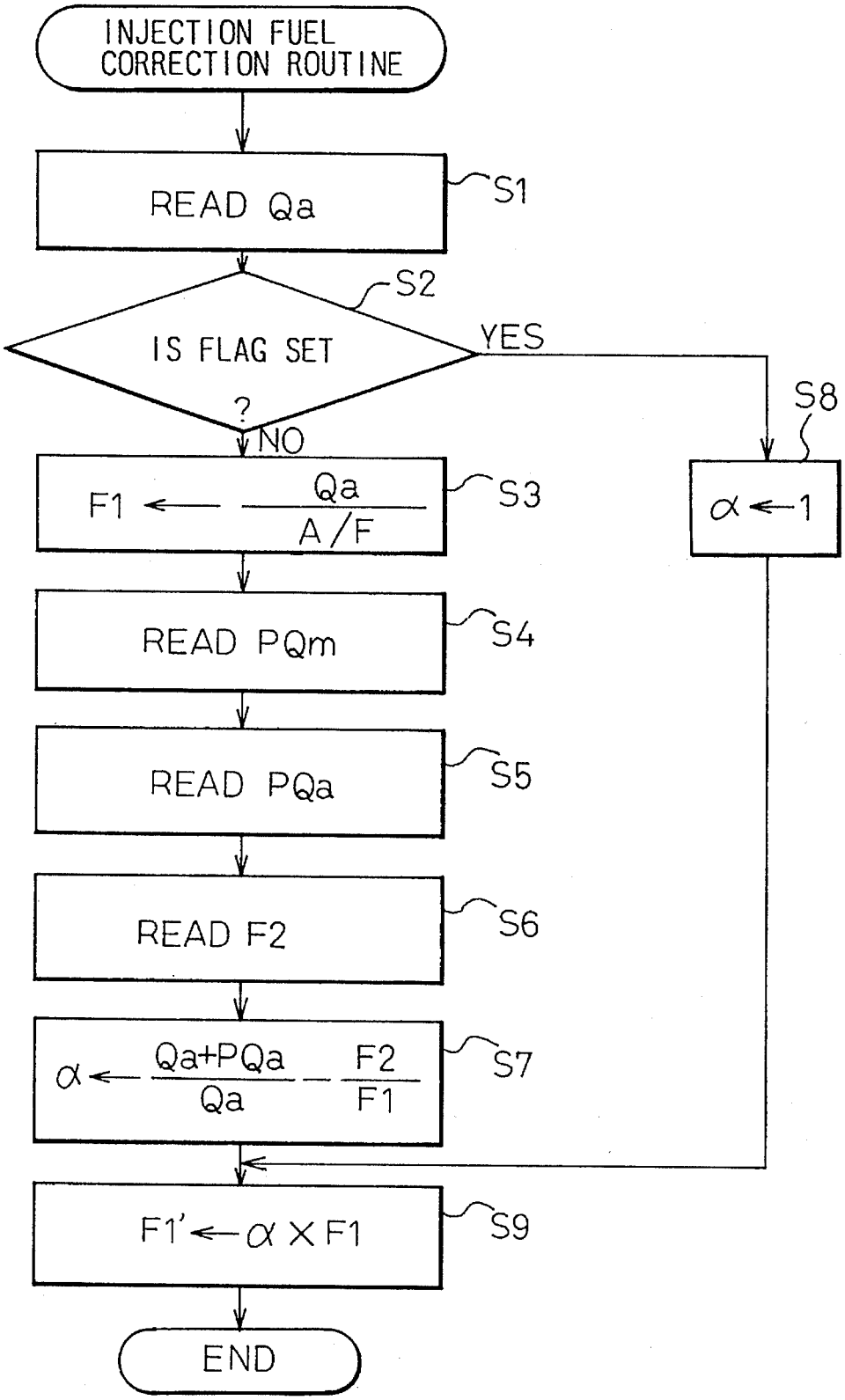
FIG. 4 is a flow chart of a routine for calculating the correction to the amount of fuel injected by the fuel injector.

FIG. 4 is a flow chart of a routine for actually executing the above described control of the correction of the amount of fuel injected from the fuel injector.

At step 1, Qa is read.

At step 2, it is determined whether or not the error flag, which is set when an error occurs in the system, is set. Since this flag is normally reset, the routine normally goes to step 3.

At step 3, F1 is calculated from the following equation;

$$F1=Qa/(A/F),$$

where A/F is an air-fuel ratio, and is a fixed value for optimal combustion, i.e. 14.7, in this embodiment, however it can be obtained by calculation.

Figure 5:
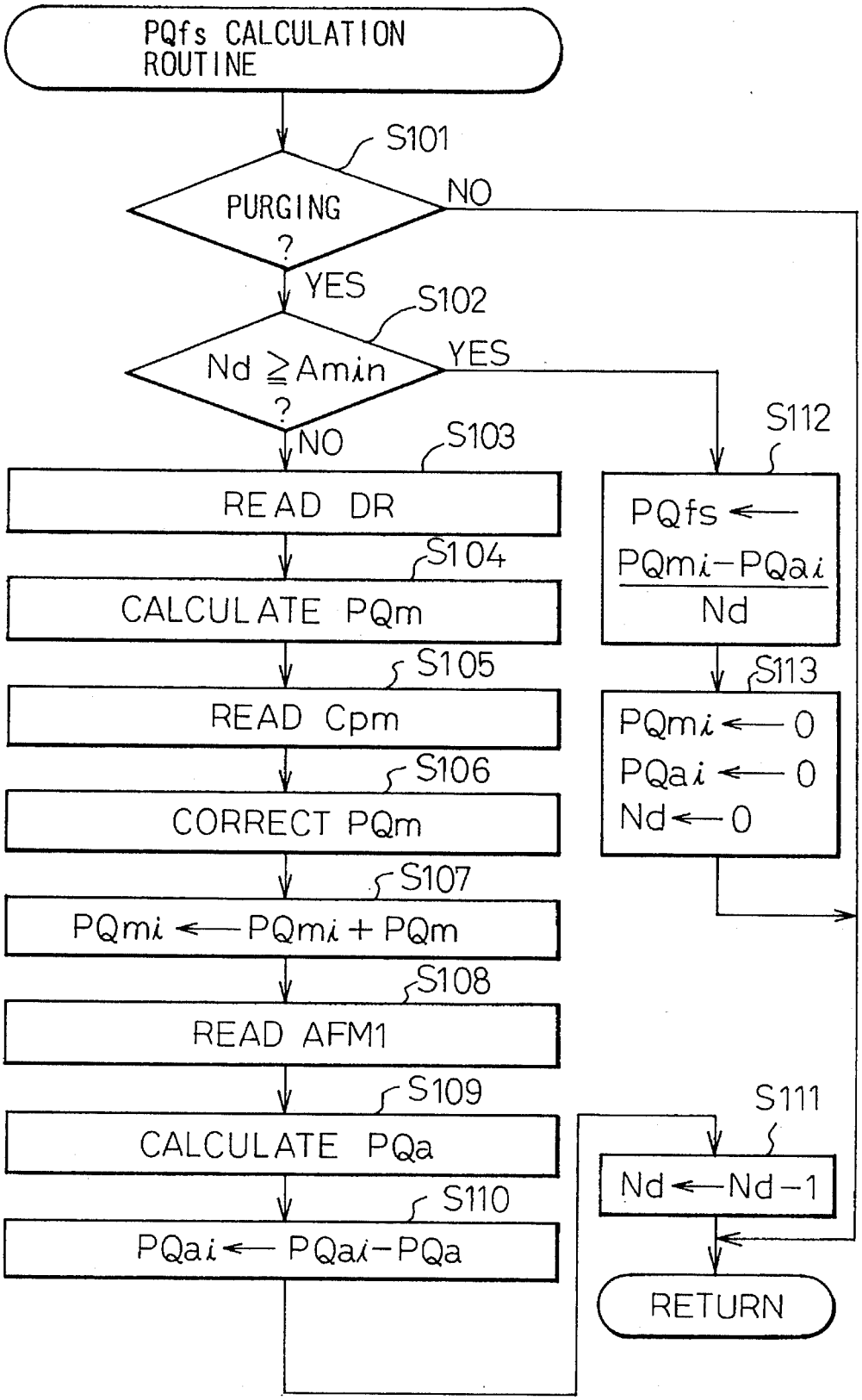
FIG. 5 is a flow chart of a routine for calculating the average of the difference between the amount of the purge gas and the amount of air in the purge gas.

At step 4, PQm which is obtained as shown in the flow chart shown in FIG. 5 is read.

At step 5, PQa, which is obtained as shown in the flow chart shown in FIG. 5, is read.

Figure 6:
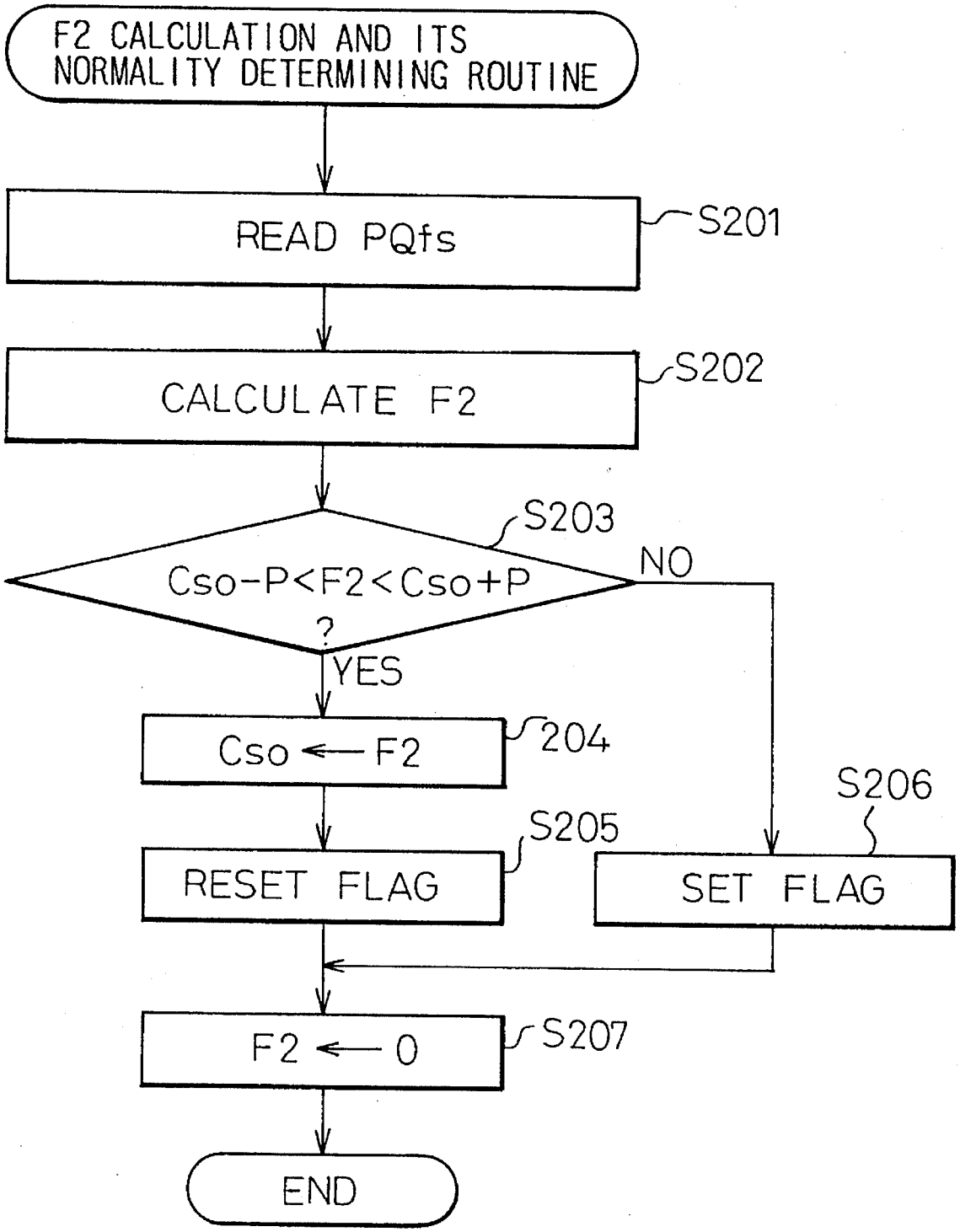
FIG. 6 is a flow chart of a routine for calculating the amount of fuel desorbed from the canister.

At step 6, F2, which is obtained as shown in the flow chart shown in FIG. 6, is read.

At step 7, the correction factor α is calculated from the following equation;

$$\alpha=(Qa+PQa)/Qa-F2/F1$$

The above equation is deduced as follows:

The total air amount Q which is introduced into the combustion chamber of the engine is a sum of Qa and PQa, therefore Q=Qa+PQa.

On the other hand, the air-fuel ratio of the mixture introduced into the combustion chamber of the engine, before the purging of the purge gas, is Qa/F1.

Therefore, to make the air-fuel ratio of the total mixture introduced into the combustion chamber of the engine, when purging is carried out, the same as the air-fuel ratio of the total mixture before the purging of the purge gas, Q/F should be equal to Qa/F1, where, F is a total amount of the fuel introduced into the engine when the purging is carried out.

Thus, Q/F=Qa/F1, namely (Qa+PQa)/F=Qa/F1, and accordingly, F=F1×(Qa+PQa)/Qa.

In the total amount of the fuel introduced into the combustion chamber of the engine F, F2 is supplied by purging from the charcoal canister, therefore, the required amount of the fuel F1' to be injected by the fuel injector is F−F2, namely F1'=F−F2.

The correction factor α is the ratio of F1' to F, therefore, α can be described as follows;

$$\begin{aligned}\alpha &= F1'/F1\\ &= (F-F2)/F1\\ &= [\{F1\times(Qa+PQa)/Qa\}-F2]/F1\\ &= \{(Qa+PQa)/Qa\}-(F-F2)\end{aligned}$$

If some error occurs and the error flag is set, the routine from step 3 skip to step 8, and the correction factor α is set to 1, namely no correction is carried out.

At step 9, the amount of the corrected fuel F1' to be injected from the fuel injector is calculated from $$F1'=\alpha\times F1$$

Thus, even when purging is carried out, the air-fuel ratio can be kept the same as the value obtained in the case of no purging. Therefore, this flow chart embodies claim 2.

FIG. 5 is a routine for calculating PQfs which is the averaged difference between PQm and PQa and used in the calculation of F2.

The method calculation is to total PQm and PQa a predetermined times and then to divide the difference between total values of PQm and PQa by the number of predetermined times.

At step 101, it is determined whether or not purging is being carried out, because this calculation is executed only when the purging is being carried out. If the purging is being carried out, the routine goes to step 102. Conversely, if the purging is not being carried out, the routine skips to the end.

At step 102, it is determined whether or not the times of totalling Nd exceeds the minimum required times Amin for averaging. If the times of totalling Nd exceeds the minimum required times Amin, the routine skips to step 112 for executing the averaging. Conversely, if the times of adding up Nd does not exceed the minimum required times Amin, the routine repeats steps 103 through step 111 for adding up the data.

At step 103, the duty ratio DR of the control signal of D-VSV 5 is read.

At step 104, PQm is calculated on the basis of a map (not shown) stored in the ECU 9 and on the duty ratio DR which is read at step 103.

Figure 8:
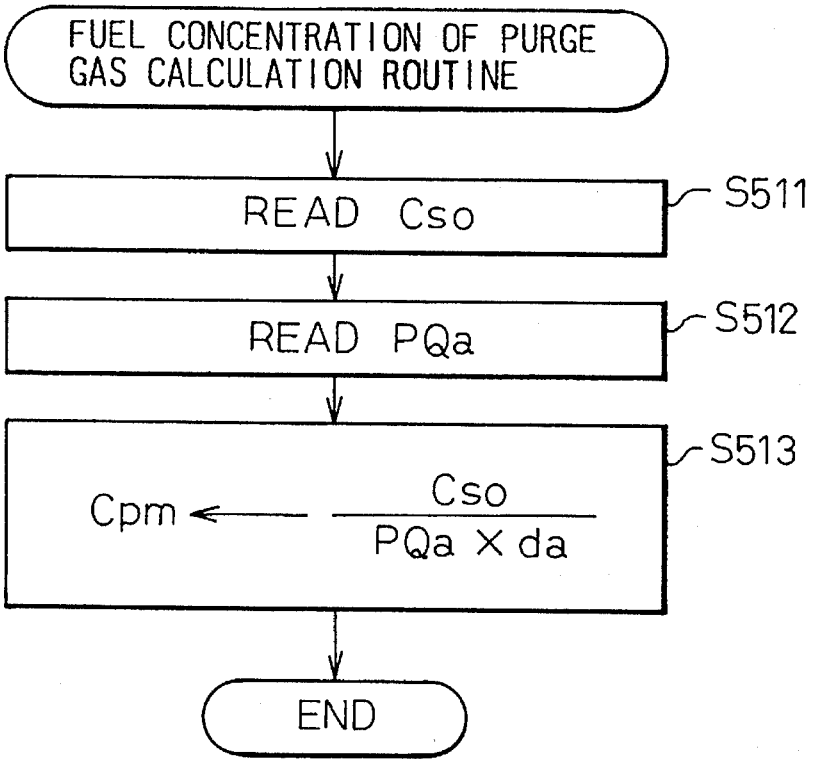
FIG. 8 is a flow chart of a routine for calculating the fuel concentration in the purge gas.
Figure 9:
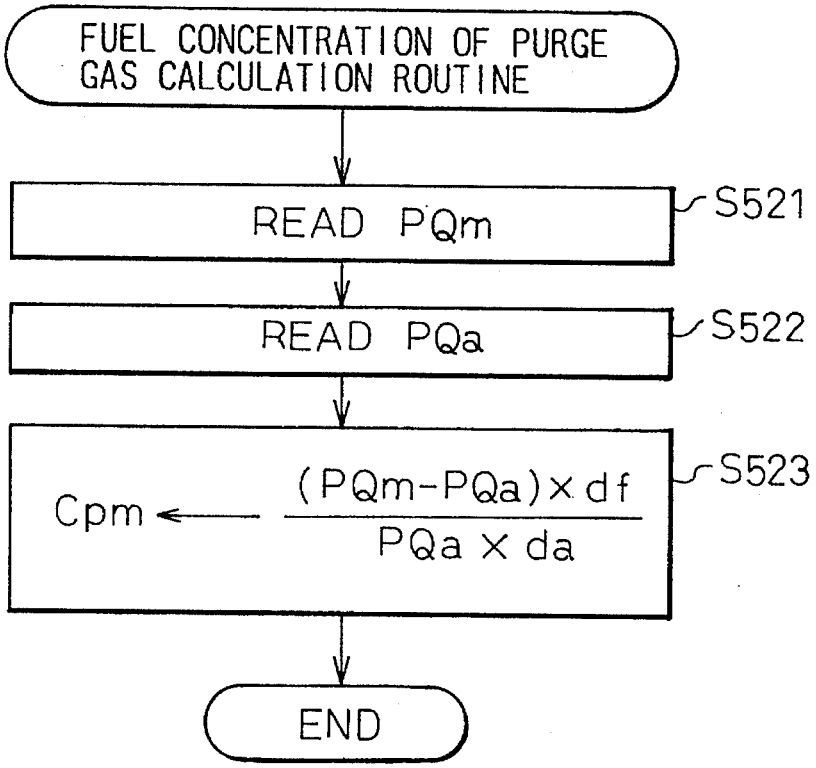
FIG. 9 is another flow chart of a routine for calculating the fuel concentration in the purge gas.

At step 105, Cpm, representing the fuel concentration of the purge gas, which is calculated by the flow chart shown in FIG. 8 or FIG. 9, is read.

At step 106, PQm is corrected on the basis of Cpm, which is read at step 105, so as to correct the effect of the fuel concentration as stated in claim 5.

At step 107, the present corrected PQm, calculated at step 106, is added to the last total value.

The above described steps, 103 through 107, are the steps which obtain the added up value of PQm.

On the contrary, the below described steps 108 through 110 are the steps which obtain the total value of PQa.

At step 108, the output AFM1 of the air flow meter 10 is read.

At step 109, PQa is calculated on the basis of a map stored in the ECU 9 and on the output AFM1 of the air flow meter 10 which is read at step 108.

At step 110, the value of PQa attained at step 109 of the present execution is added to the last total value.

Then, the routine goes to step 111, where Nd is incremented to Nd+1.

Step 112 is a step for calculating the average value of PQfs, and this step is executed, when Nd exceeds Amin, using the following equation.

$$PQfs=(PQmi-PQai)/Nd$$

After calculation of the PQfs at step 112, the routine goes to step 113, where PQmi, PQai and Nd are reset to zero.

The flow chart shown in FIG. 6 is a routine for calculating F2 on the basis of the PQfs calculated at step 112 of the flow chart shown in FIG. 5 and includes a routine to detect an abnormality thereof, therefore this flow chart embodies the claim 3.

At step 201, the PQfs calculated at step 112 of the flow chart shown in FIG. 5 is read.

At step 202, F2 is calculated on the basis of PQfs and of a map which is made on the basis of the test results shown in FIG. 2 and stored in the ECU 9.

Figure 7:
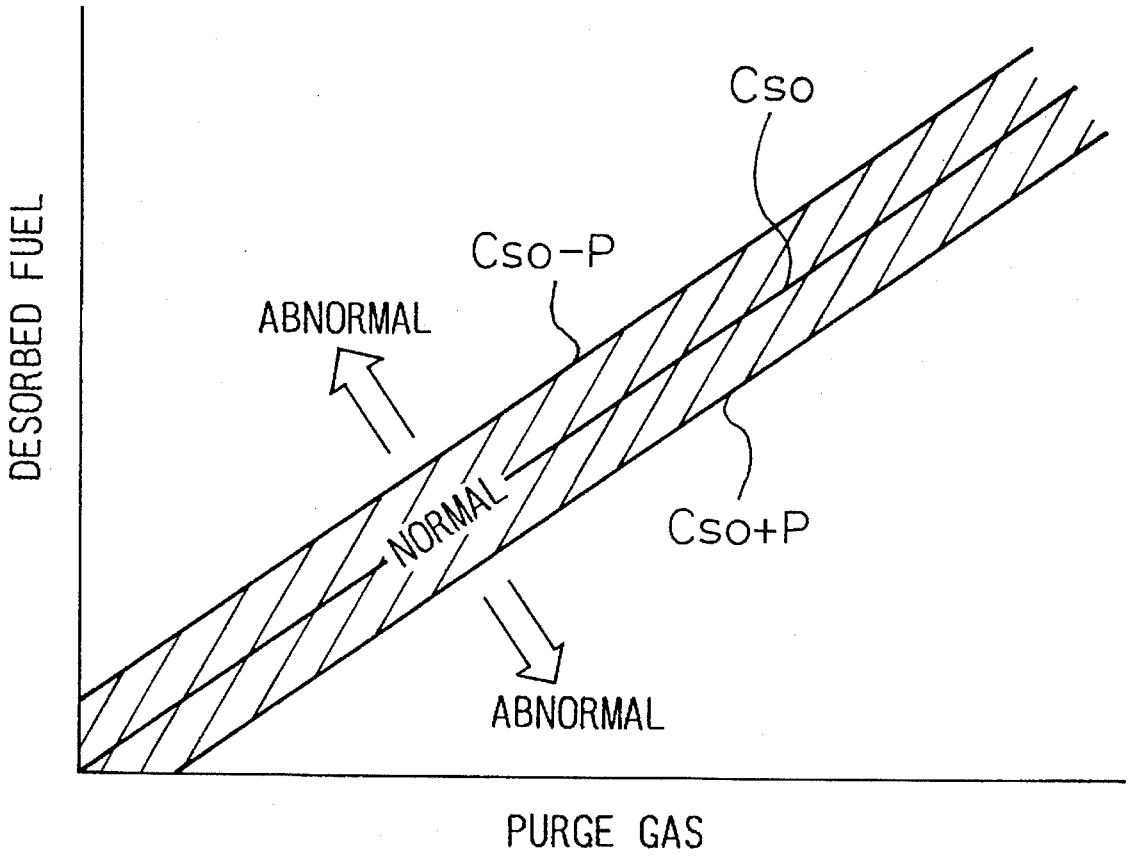
FIG. 7 is a diagram illustrating a normal and an abnormal region of the amount of desorbed fuel from the charcoal canister corresponding to the amount of the purge gas.

At step 203, it is determined whether the F2 calculated in step 202 is tolerable or not relative to the amount of purge gas by using a map shown in FIG. 7, which is stored in ECU 9. Namely, whether the equation $Cso-P<F2<Cso+P$, is satisfied or not is determined, where Cso is a normal mean value relative to the amount of purge gas and P is a tolerance.

If the above calculated F2 is tolerable, then the routine goes step 204 through step 205.

At step 204, Cso is replaced by F2.

At step 205, a flag for indicating an abnormality is cleared to zero and control goes to step 207.

If it is determined that F2 is not tolerable at step 203, the routine skips to step 206 and a flag for indicating abnormality is set, and then the routine goes to step 207.

At step 207, F2 is cleared to zero.

Since this flow chart includes steps for detecting an abnormality, as described above, deterioration of the charcoal canister and other abnormalities can be detected.

The flow chart shown in FIG. 8 is a routine for calculating the concentration of purge gas which is read at step 105 of the flow chart shown in FIG. 5.

At step 511, a normal mean value Cso of the desorbed fuel is read. At step 512, PQa is read. At step 513, Cpm is calculated from the following equation;

$$Cpm=Cso/(PQa\times da)$$

where da is the density of air.

The flow chart shown in FIG. 9 is another routine for calculating a concentration of purge gas which is read at step 105 of the flow chart shown in FIG. 5.

At step 521, PQm is read. At step 522, PQa is read.

At step 523, Cpm is calculated from the following equation;

$$Cpm=\{(PQm-PQa)\times df\}/(PQa\times da)$$

where df is the density of the fuel.

Figure 10:
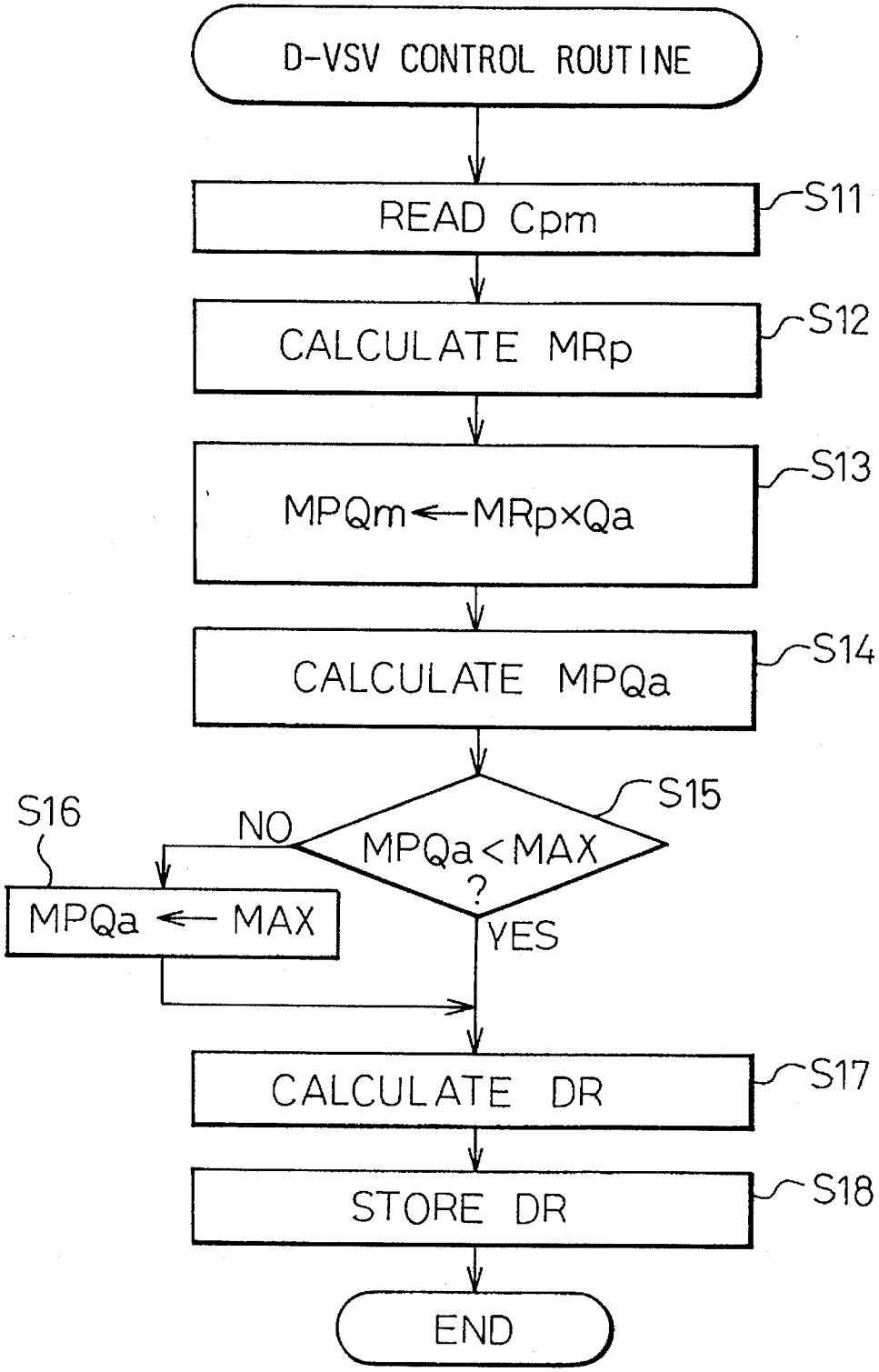
FIG. 10 is a flow chart of a routine for controlling the Duty Vacuum Switching Valve (D-VSV) so as to keep the flow rate of air introduced into the canister under a predetermined value.

The flow chart shown in FIG. 10 is a routine for controlling the D-VSV 5 so that the amount of air introduced into the charcoal canister 1 is less than the predetermined value.

At step 11, Cpm, calculated by the flow chart shown in FIG. 8 or 9, is read.

At step 12, a target purge ratio MRp corresponding to a driving condition is calculated from a map which is stored (not shown) in the ECU.

At step 13, the target amount of the purge gas MPQm is calculated from the following equation;

$$MPQm=MRp\times Qa$$

At step 14, a target amount of air introduced into the charcoal canister MPQa is calculated on the basis of MPQm and Cpm.

At step 15, it is determined whether or not the target amount of air introduced into the charcoal canister MPQa is less than the predetermined upper limit.

If MPQa exceeds the predetermined upper limit MAX the routine goes to step 17, through step 16 in which MPQa is replaced by the predetermined upper limit MAX.

On the contrary, if MPQa is less than the predetermined upper limit MAX the routine goes directly to step 17.

At step 17, duty ratio DR, which corresponds to MPQm is calculated from a map (not shown) which is stored in ECU 9.

At step 18, the duty ratio DR calculated at step 17 is stored.

Afterwards, the D-VSV 5 is controlled by reading the above stored value.

As described above, according to the flow chart shown in FIG. 10, the D-VSV 5 is controlled so that the air introduced into the charcoal canister is less than the predetermined value, therefore this flow chart embodies claim 4.

We claim:

1. An evaporative fuel control device for an engine used in an automobile, the evaporative fuel control device comprising:

a canister for temporarily adsorbing fuel vapor produced in a fuel tank;

an air introducing means for introducing pure air into an upstream end of said canister;

an air amount sensor for detecting an mount of pure air, all of which is introduced into the upstream end of said canister;

a purge gas amount calculating means for calculating the amount of purge gas purged from a downstream end of said canister, said purge gas including pure air and fuel vapor desorbed from said canister;

a desorbed fuel amount calculating means for calculating the amount of fuel desorbed from said canister on the basis of a difference between the amount of purge gas calculated by said purge gas amount calculating means and the amount of pure air actually introduced into the upstream end of the canister detected by said air amount sensor; and a purge gas control means for controlling the amount of purge gas purged from said canister into an intake passage of said engine on the basis of the amount of fuel desorbed from said canister calculated by said desorbed fuel amount calculating means.

2. An evaporative fuel control device according to claim 1, further comprising:

an injection fuel correcting means for correcting the amount of fuel injected from a fuel injector so that the total air-fuel mixture introduced into the combustion chamber of said engine has a predetermined air-fuel ratio, said correcting means correcting the amount of fuel injected from the fuel injector on the basis of the amount of fuel desorbed from said canister, said amount of fuel desorbed from said canister calculated by desorbed fuel amount calculating means.

3. An evaporative fuel control device according to claim 1, further comprising:

a failure detecting means for detecting a failure when the amount of fuel desorbed from said canister deviates from a predetermined range in relation to the amount of the purge gas detected by said purge gas amount detecting means.

4. An evaporative fuel control device according to claim 1, wherein said purge gas control means controls the purge gas so that the amount of air introduced into said canister is kept within the predetermined range.

5. An evaporative fuel control device according to claim 1, further comprising;

a purge gas amount correcting means for correcting the amount of purge gas calculated by said purge gas amount calculating means through a fuel concentration of the purge gas which is derived on the basis of the amount of fuel desorbed from said canister calculated by the desorbed fuel amount calculating means.

6. A device as recited in claim 1, wherein the canister for temporarily adsorbing fuel vapor comprises an activated carbon layer.

7. A method for controlling evaporative fuel in an engine used in an automobile, comprising the steps of:

a) temporarily adsorbing in a canister fuel vapor produced in a fuel tank;

b) introducing pure air into an upstream end of said canister;

c) detecting the amount of pure air all of which is actually introduced into the upstream end of said canister;

d) purging purge gas including desorbed fuel vapor and pure air from a downstream end of said canister;

e) calculating the amount of the purge gas purged from the downstream end of said canister;

(f) calculating the mount of fuel desorbed from said canister on the basis of a difference between the amount of purge gas purged from the downstream end of said canister and the amount of pure air introduced into the upstream end of said canister; and g) controlling the amount of purge gas purged from said canister into an intake passage of said engine on the basis of the amount of fuel desorbed from said canister.

8. A method as recited in claim 7, further comprising the step of:

h) correcting the amount of fuel injected from a fuel injector so that the total air-fuel mixture introduced into the combustion chamber of said engine has a predetermined air-fuel ratio; the step of correcting the amount of fuel injected from a fuel injector being based on the amount of fuel desorbed from said canister.

9. A method as recited in claim 7, further comprising the step of:

h) detecting a failure when the amount of fuel desorbed from said canister deviates from a predetermined range in relation to the amount of the purge gas purged from said canister.

10. A method as recited in claim 7, wherein the step of controlling the amount of purge gas purged from said canister includes:

controlling the amount of purge gas purged from said canister so that the amount of air introduced into said canister is kept within the predetermined range.

11. A method as recited in claim 7, further comprising the step of:

h) correcting the amount of purge gas purged from said canister by based upon the fuel concentration of the purge gas, said concentration being derived based on the amount of fuel desorbed from said canister.

12. An evaporative fuel control device for an engine used in an automobile, the evaporative fuel control device comprising:

a) a canister for temporarily adsorbing fuel vapor produced in a fuel tank;

b) an air flow meter for detecting an amount of air all of which is actually introduced into an upstream end of said canister;

c) an engine control unit for calculating an amount of purge gas purged from a downstream end of said canister, said purge gas including fuel desorbed from the canister and pure air and for calculating the amount of fuel desorbed from said canister on the basis of the amount of purge gas purged from said canister and the amount of pure air introduced into said canister detected by said air flow meter; and d) a valve for controlling the amount of purge gas purged from the downstream end of said canister into an intake passage of said engine, said purge gas containing pure air and fuel vapor desorbed from said canister, said valve controlling the amount of purge gas on the basis of a control signal from said engine control unit.

13. A device as recited in claim 12, wherein the canister for temporarily adsorbing fuel vapor comprises an activated carbon layer.

14. A device as recited in claim 12, wherein the valve for controlling the amount of purge gas purged from said canister comprises a duty vacuum switching valve.

* * * * *

UNITED STATES PATENT AND TRADEMARK OFFICE

CERTIFICATE OF CORRECTION

PATENT NO. : 5,609,141

DATED : March 11, 1997

INVENTOR(S) : Hiroki MATSUOKA, et al.

It is certified that error appears in the above-indentified patent and that said Letters Patent is hereby corrected as shown below:

ABSTRACT, line 3, change "temporary" to --temporarily--.

ABSTRACT, line 6, delete the comma after "gas" and change "a" to --an--.

Column 1, line 10, change "temporary" to --temporarily--.

Column 1, line 42, change "temporary" to --temporarily--.

Column 2, line 57, delete "is".

Column 2, line 66, change "a" to --an--.

Column 3, line 6, change "a" to --an--.

Column 3, line 25, change "is" to --are--.

Column 4, line 58, change "skip" to --skips--.

Column 5, line 5, before "times" insert --number of--.

Column 6, line 4, after "goes" insert --to--.

Column 7, line 46, before "purge" at end of line insert --the amount of--.

UNITED STATES PATENT AND TRADEMARK OFFICE

CERTIFICATE OF CORRECTION

PATENT NO. : 5,609,141 Page 2 of 3

DATED : March 11, 1997

INVENTOR(S) : Hiroki MATSUOKA, et al.

It is certified that error appears in the above-indentified patent and that said Letters Patent is hereby corrected as shown below:

Column 7, line 47, before "air" insert --pure-- and before "said" insert --the upstream end of--.

Column 8, line 24, before "said" insert --the downstream end of--.

Column 8, line 26, before "said" insert --the downstream end of--.

Column 8, line 30, before "said" insert --the downstream end of--.

Column 8, line 35, before "said" insert --the downstream end of--.

Column 8, line 36, delete "by".

UNITED STATES PATENT AND TRADEMARK OFFICE

CERTIFICATE OF CORRECTION

PATENT NO. : 5,609,141

DATED : March 11, 1997

INVENTOR(S) : Hiroki MATSUOKA, et al.

It is certified that error appears in the above-indentified patent and that said Letters Patent is hereby corrected as shown below:

Column 8, line 50, after "air" insert a comma.

Signed and Sealed this

Sixteenth Day of September, 1997

*Attest:*

Bruce Lehman

BRUCE LEHMAN

*Attesting Officer*

*Commissioner of Patents and Trademarks*